US006189360B1

(12) United States Patent
Hatty

(10) Patent No.: US 6,189,360 B1
(45) Date of Patent: Feb. 20, 2001

(54) METAL FORMING MACHINE

(75) Inventor: Thomas J. Hatty, Sterling Heights, MI (US)

(73) Assignee: Sanyo Machine America Corp., Rochester, MI (US)

( * ) Notice: Under 35 U.S.C. 154(b), the term of this patent shall be extended for 0 days.

(21) Appl. No.: 09/332,851

(22) Filed: Jun. 14, 1999

Related U.S. Application Data

(60) Provisional application No. 60/089,313, filed on Jun. 15, 1998.

(51) Int. Cl.[7] ..... B21D 39/02

(52) U.S. Cl. ..... 72/308; 72/312; 72/323; 29/243.58

(58) Field of Search ..... 72/308, 323, 312–315, 72/381, 452.9; 29/243.58

(56) References Cited

U.S. PATENT DOCUMENTS 4,346,579 * 8/1982 Takatsu ..... 72/314
5,269,167 * 12/1993 Gerhart ..... 72/315
5,347,838 * 9/1994 Matsuoka ..... 72/312
5,740,691 * 4/1998 Kovarovic ..... 72/323
5,746,082 * 5/1998 Matsuoka ..... 72/313
5,904,064 * 5/1999 Higuchi ..... 72/381

FOREIGN PATENT DOCUMENTS

184530 * 11/1982 (JP) ..... 72/313

* cited by examiner

*Primary Examiner*—Daniel C. Crane

(57) ABSTRACT

A metal forming machine includes a moveable central pillar, a slidable blade assembly mounted to the pillar for reciprocating movement therewith, and a fixed slide plate mounted to a stationary block secured to the pillar. A moveable or slideable blade holder of the blade assembly and having a ramped wall carries a blade or forming element mounted thereto. Respective wear plates mounted to the slide plate and blade holder contact each other during movement of the pillar. A blade or forming element secured to the slidable holder contacts metal to be formed or pierced. The stop block assembly associated with the slidable blade holder limits movement of the blade in a first direction such that continued force applied thereto during movement of the pillar causes movement of the blade or forming element in a second direction transverse to that of the first direction.

9 Claims, 8 Drawing Sheets

FIG 4
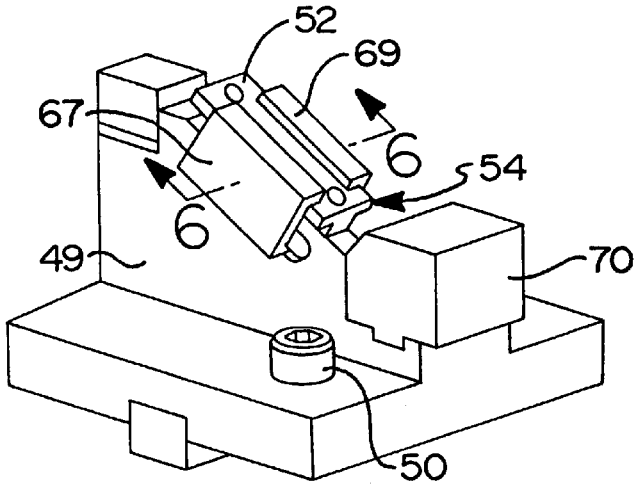
FIG 6
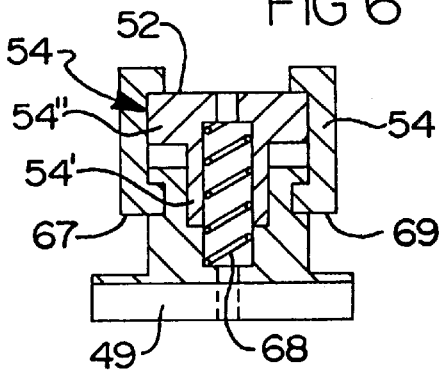
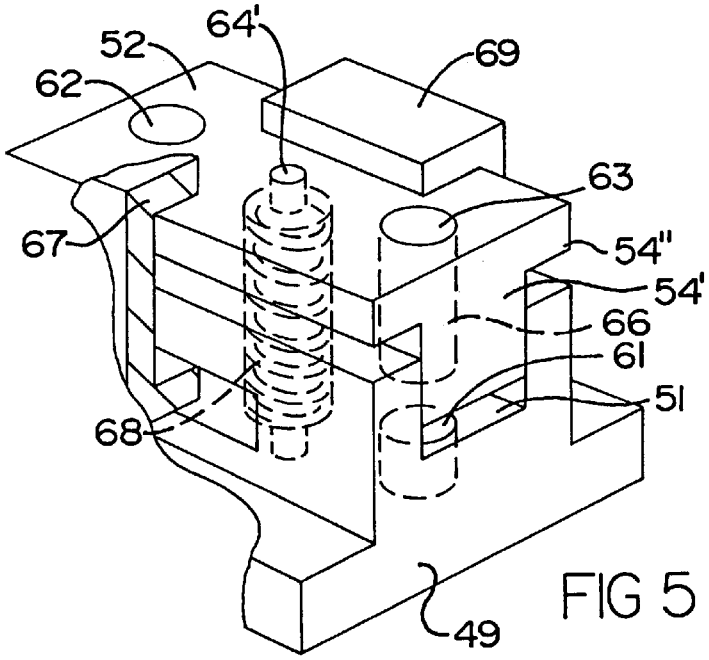
FIG 5

FIG 11
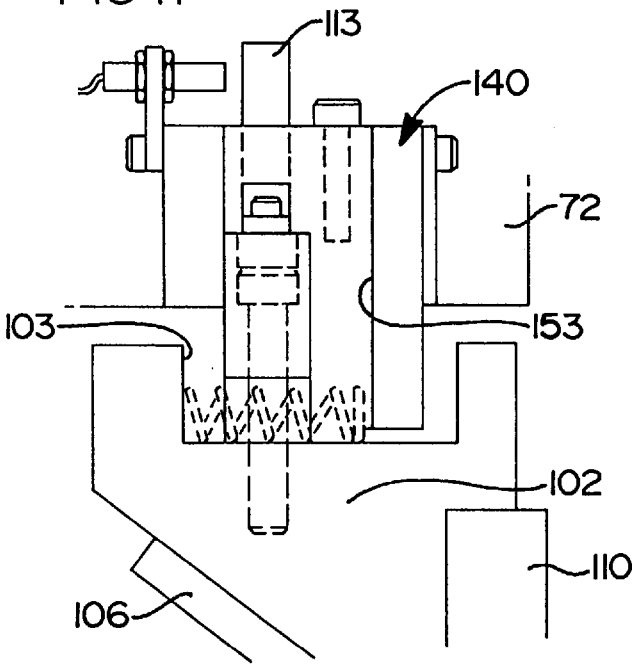
FIG 12
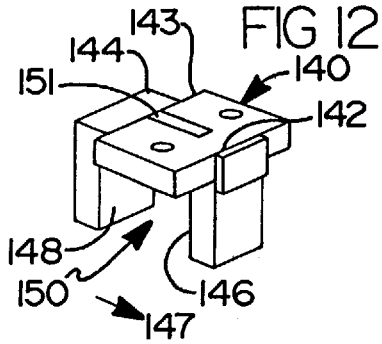
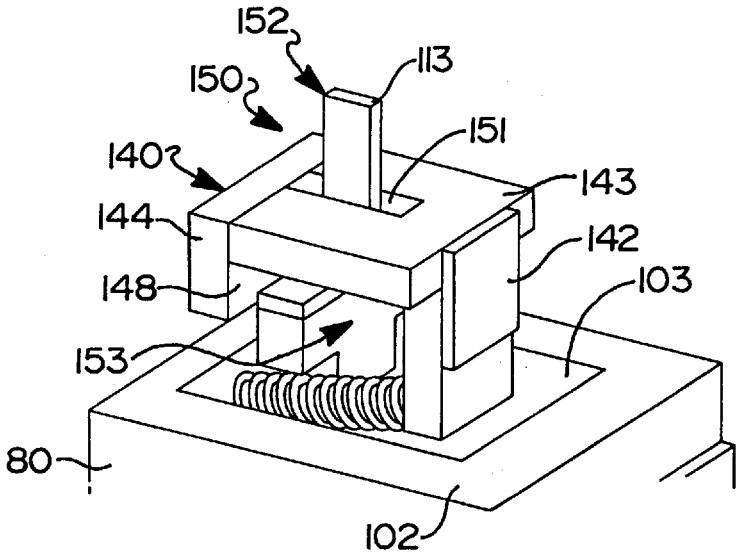
FIG 10

METAL FORMING MACHINE

CROSS-REFERENCE TO RELATED APPLICATIONS

This application is a completion application of co-pending U.S. Provisional Patent Application Serial No. 60/089,313, filed Jun. 15, 1998, for "Metal Forming Machine", the disclosure which is hereby incorporated by reference.

BACKGROUND OF THE INVENTION

1. Field of the Invention

The present invention pertains to metal forming machines. More particularly, the present invention pertains to metal forming machines for bending metal about an aperture formed in the metal. Even more particularly, the present invention concerns metal bending machines particularly adapted for bending tabs about a window opening formed in sheet metal.

2. Prior Art

As is known to those skilled in the art to which the present invention pertains, metal bending and/or deformation operations to effect certain shapes, bends, etc., in metal objects, as well as attachments thereto, such as is encountered with door panels and the like, is a highly developed and sophisticated art. Yet, with thin sheet metal, such as vehicular exterior skins and the like, during post stamping and bending operations, there is a tendency for the thin sheet metal to be crimped, dented, scarfed or deformed. Although this may not create an impediment to the subsequent use of the product in certain situations, ordinarily where coatings, such as high gloss paint or the like is applied to the metal, any deformation in the metal may become highlighted thereby diminishing the utility of the product. As noted, this is especially true with automotive door panels, which is the first place, where potential buyers look for defects.

As detailed below, the present invention has particular utility in connection with automotive door panels and similar type structures.

Automotive door panels are fabricated from thin sheet metal in which a central opening is formed and which defines, ultimately, the opening in which is mounted the window. In developing a "window" in the opening, ordinarily, a pair of spaced apart door panels are used with the requisite "hardware", i.e., window track, motor or regulator, etc., disposed in the cavity between the panels. Also, a seal or weather strip, as well as a drip rail or the like is, usually, disposed about the perimeter of the opening. The weather seal, glass assembly and/or drip rail are enveloped by, and held in place by tabs which are, usually, welded into place, as a tab strip, around the window opening after the sheet metal is stamped out. Thus, these tabs are circumferentially disposed, perimetrally about the window opening. Prior to installing the weather strip, window assembly, etc., the flange or strip onto which the tabs are formed or provided is bent to accommodate installation of the appropriate hardware to be disposed about the window opening. Heretofore, this tab-bearing flange bending process has had the tendency to deform the sheet metal. The present invention is defined by a metal forming machine which, as is detailed subsequently, alleviates this problem. However, it is to be understood that although the present invention is described with reference to a tab bending procedure the principles and concepts upon which the present invention is predicated are applicable to any type of metal forming process where bending and/or piercing of the metal is desired.

SUMMARY OF THE INVENTION

In accordance herewith the present invention provides a metal forming machine for bending and/or piercing of the metal. The present invention is particularly adapted for bending the tabs disposed about a window opening in a vehicular door assembly.

Thus, in its broadest context, the present invention is defined by a metal forming machine which, generally, comprises:

a. a central movable pillar or drive shaft;

b. a slidable blade assembly mounted to the pillar and movable therewith, the blade assembly including:

(i) a slidable holder, the holder including a ramped surface, and (ii) a forming element mounted to the holder and slidable therewith;

c. a stationary slide plate which mates with the slidable holder for guiding the holder in a path of travel along the ramped surface; and d. means for driving the shaft.

In use, the central pillar projects through an opening formed in the sheet metal or work piece upon which the metal bending operation is performed. The shaft is driven through a suitable drive mechanism to render it extendable and retractable. Depending on the drive mechanism or means for driving the shaft, the machine or device hereof may be rendered as a table top fixture or as a floor mounted direct drive device.

For a more complete understanding of the present invention reference is made to the following detailed description and accompanying drawing. In the drawing like reference characters refer to like parts throughout the several views in which:

BRIEF DESCRIPTION OF THE SEVERAL VIEWS OF THE DRAWING

FIG. 4 is a perspective view of the cam driver hereof;

FIG. 5 is a partial perspective view, partly in phantom and in section of the slide plate portion of the cam driver, of the present machine;

FIG. 6 is a cross-sectional view taken along line 6—6 of FIG. 4;

FIG. 10 is a perspective view of the shuttle stop block assembly and the blade holder assembly;

FIG. 11 is a side elevational view, similar to FIG. 8 but detailing the shuttle stop block portion; and FIG. 12 is a perspective view of the bumper portion of the shuttle stop block assembly.

DETAILED DESCRIPTION OF THE INVENTION

Now, and in accordance herewith and as noted hereinabove the present invention is defined by a metal forming machine which is applicable to any type of metal forming process where bending and/or piercing of the metal is desired. Although the ensuing description of the invention is defined with respect to a tab bending procedure associated with window openings for door panels for automobiles or similar vehicles, it is to be understood that the present invention is not so limited.

Generally, the present invention is defined by a metal forming machine comprising:

(a) a central movable pillar or drive shaft;

(b) a slidable blade assembly mounted to the pillar and movable therewith, the blade assembly including:
  (i) a slidable holder, the holder including a ramped surface, and
  (ii) a forming element mounted to the holder and slidable therewith;

(c) a stationary slide plate which mates with the slidable holder for guiding the holder in a path of travel along the ramped surface, and (d) means for driving the shaft.

It should be noted with respect hereto that the ensuing description of the particular embodiment hereof is made with reference to a table top fixture. However, it is to be understood that the metal forming device hereof can be incorporated into a transfer machine and as part and parcel of an entire assembly line. However, for purposes of describing the present invention, reference to a tabletop fixture is made.

Figure 1:
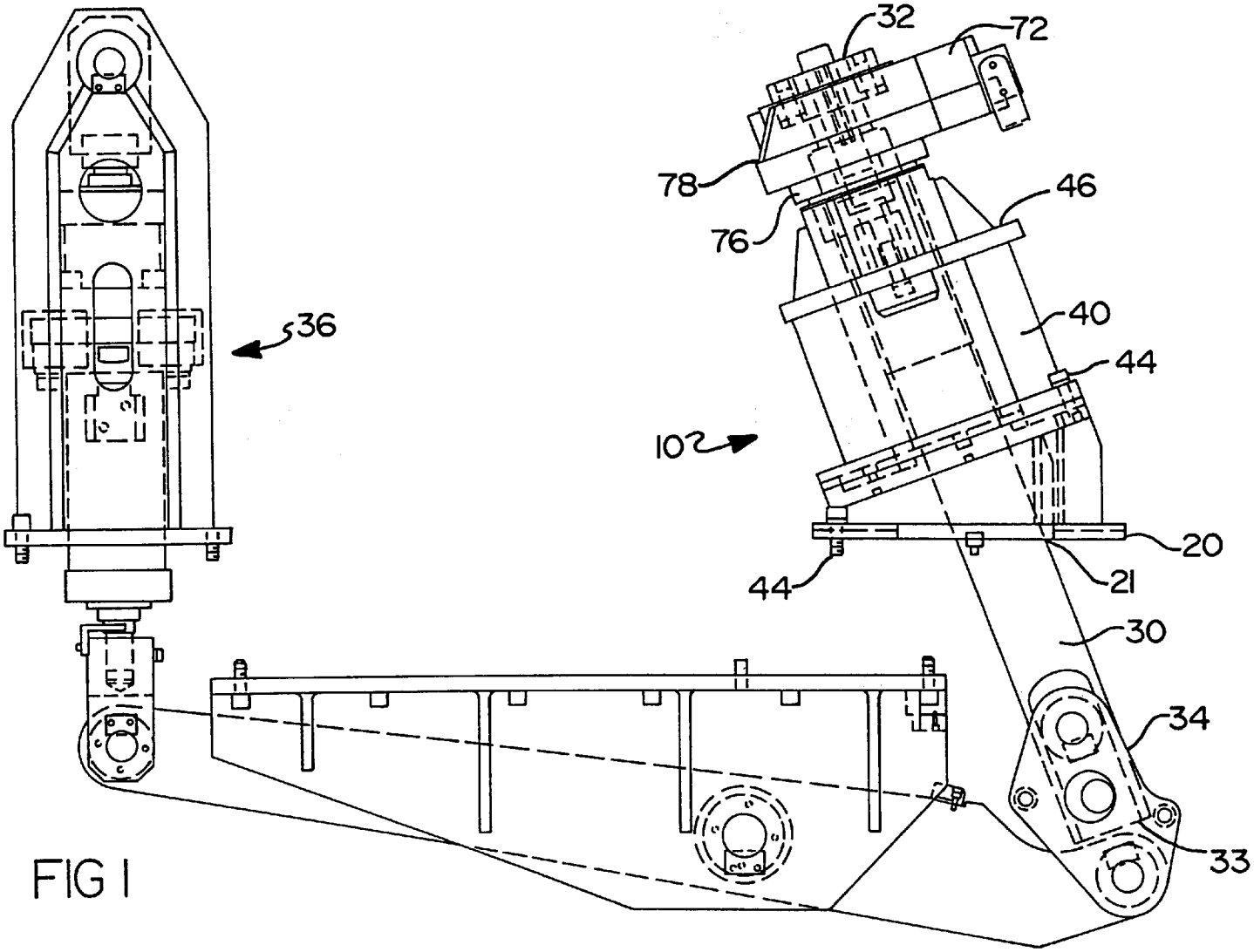
FIG. 1 is a partial side elevational view, partly in phantom, of a metal forming machine including a reciprocating pillar or drive shaft thereof in accordance herewith.
Figure 2:
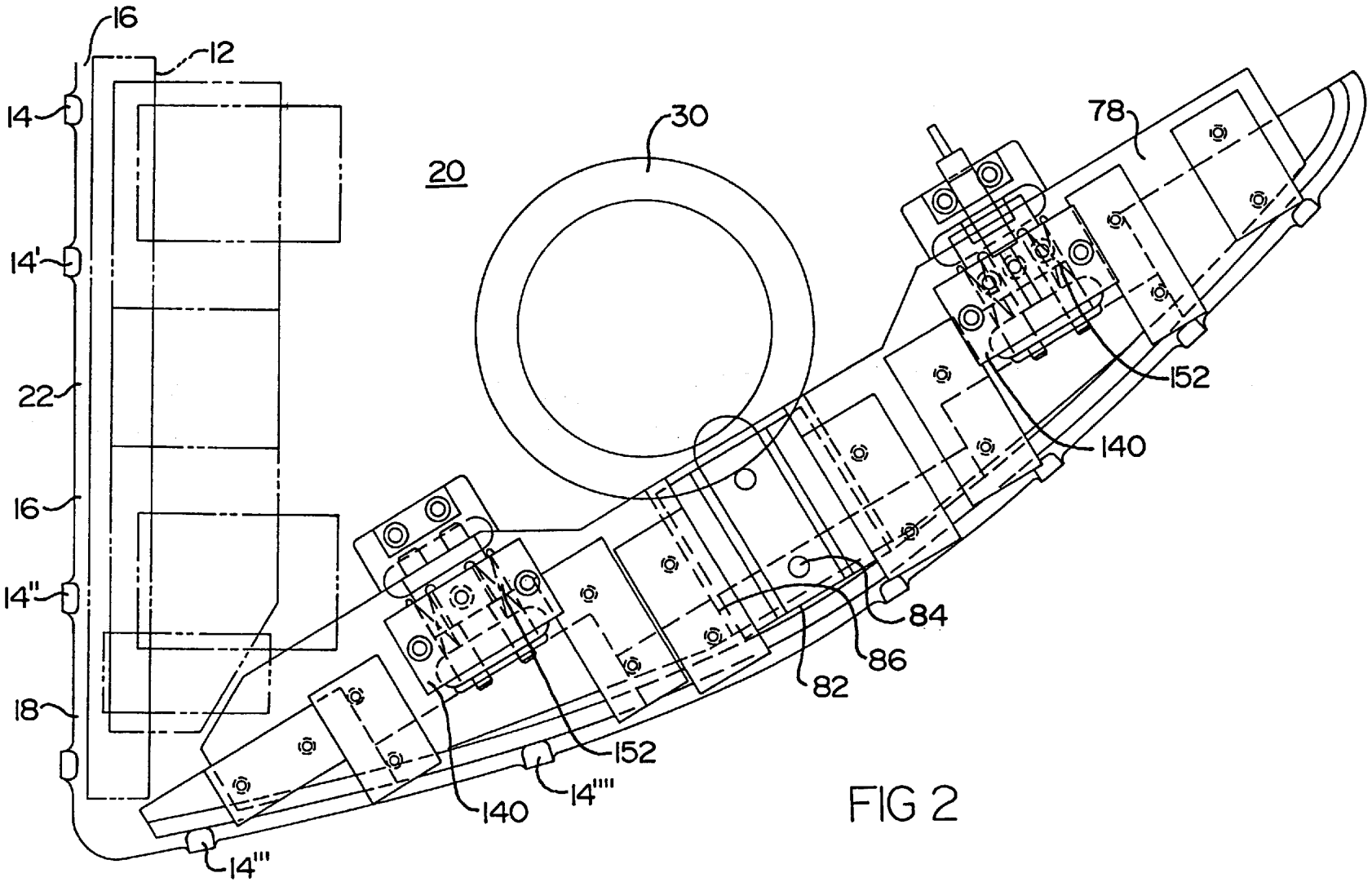
FIG. 2 is a top plan view of the metal forming machine hereof, in use.
Figure 3:
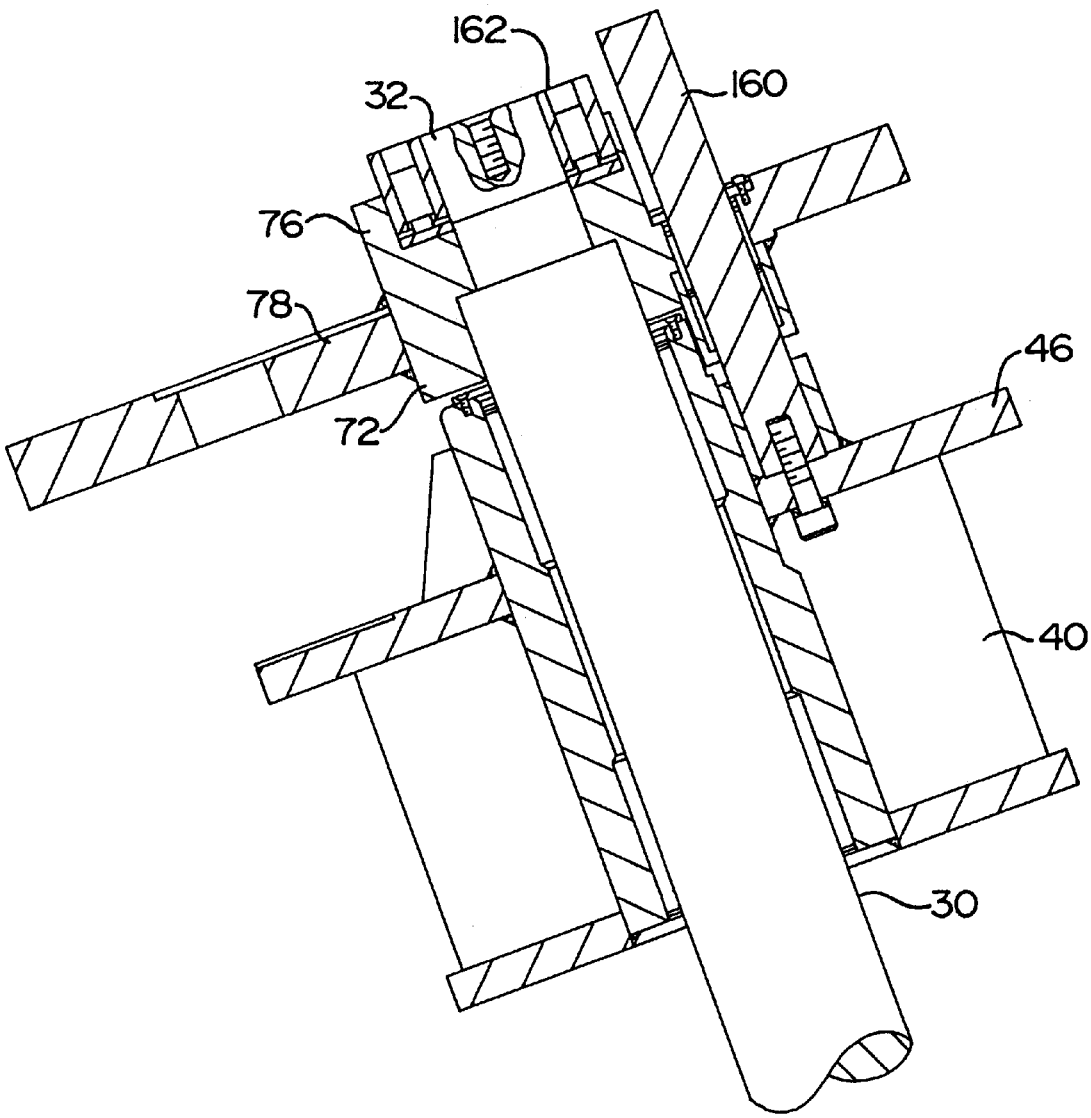
FIG. 3 is a partial cross-sectional view of the central pillar, crown and guide housing that exercises the pillar.

Now, and with more particularity, and with particular reference to FIGS. 1, 2 and 3, there is depicted therein a metal forming device in accordance with the present invention and, generally, denoted at 10. As is known to those skilled in the art, in rendering the present device as a table top fixture, there is ordinarily provided a base or table which is dimensioned to seat thereon a metal forming fixture, which holds a workpiece during the metal forming operation. The table usually includes a pedestal which is an upstanding member having a first ground-engaging end and an opposed or opposite end. A horizontal table top seats atop the opposed end and is used to mount the fixture thereunto. For reference purposes, a table top is here shown at 20. The table top 20 may have any desired configuration as necessary to mount the device thereunto.

Ordinarily, a plurality of clamping members (not shown) are circumferentially disposed about the fixture and are used to hold the work piece in place. The clamping members may be hydraulically actuated, pneumatically actuated, mechanically actuated, electronically actuated, electro-mechanically actuated, or the like. These clamping members are well known and commercially available.

The clamping members and their construction are not critical to the present invention, but are an essential element for metal forming to hold the work piece in position during the metal forming operation. The clamping members are synchronized to co-act with the metal forming elements and are cycled therewith for automated metal forming, again, in a manner well known to the skilled artisan.

As noted hereinabove, the fixture is seated atop and is secured to the table 20 by any well known manner, such as threaded fasteners, bolts or the like. Although not shown, it is known that a fixture includes a seat upon which the work piece sits.

For purposes of describing the present invention, depicted herein is a portion of an automotive door panel denoted at 22, which is the work piece upon which the present device operates. The automotive door panel 22 has a window aperture or opening 12 formed in the sheet metal thereof. The fixture seats the panel 22 to hold it in place.

A plurality of tabs 14, 14', etc. are disposed about the opening 12 and are secured thereto, usually, by welding. Ordinarily, the tabs 14 are integrally formed with a metal strip 16. The strip 16 includes a flange 18 which is bent during the bending process hereof to rotate the tabs about 45° to thereby render them substantially perpendicular to the plane of the opening 12. The tabs 14, 14', etc. project outwardly from the strip 16 and are integral therewith.

As will be discussed hereinbelow, the present invention is particularly suited for metal forming operations about the opening 12, such as tab bending, because it enables the metal forming to be performed outwardly or outboard of the opening as the key elements of the device are disposed within the volume defined by the opening.

The metal forming elements are, thus, arrayed in a manner corresponding to the perimetral configuration of the opening 12 in the work piece 22.

The metal forming device 10 hereof includes a central pillar or drive shaft 30. The central pillar or drive shaft 30 is a key element of the present invention in that it enables the outward deformation of metal about the opening. Thus, it is to be appreciated that the central pillar or drive shaft 30 projects through the opening 12 formed in the sheet metal or workpiece or door panel 22.

Here, the shaft 30 extends through the table top 20 through a suitable opening 21 formed therein and through the opening 12 of the panel 22. The shaft has a first or upper end 32 and a second or lower end 33. The lower end 33 of the shaft 30 is connected to a suitable drive mechanism, such as a rocker mechanism 34 or the like for transmitting motion to the pillar. It is to be appreciated that the rocker mechanism may be connected to a laterally disposed cylinder or other power source 36 for driving and retracting the shaft 30. This lateral disposition and the utilization of the rocker mechanism enables the present invention to be incorporated into a table top fixture. However, it is to be appreciated that if sufficient floor space is available, a direct drive may be employed. The type of drive is not critical to the metal forming device itself. However, by incorporating a rocker mechanism for driving the pillar, the table top disposition of the metal forming device hereof is enabled.

Referring now to the Figures, and in particular to FIGS. 1 and 3, it is seen that a housing 40 circumferentially envelops the central pillar or drive shaft 30. The housing 40 is used to secure the central pillar, as well as the metal forming assembly thereof, to the table top 20 through suitable fasteners such as bolts or the like, such as is illustrated at 44.

The housing 40 is a substantially cylindrical element, having an upper ledge or top 46. Seated atop the housing 40 is a lower block or cam driver 48.

The cam driver or lower block 48 comprises a substantially solid body 49 which is secured to the top of the housing 40 through suitable fasteners, such as bolts 50. The body 49 has an upper inclined or ramped wall upon which is seated a slide plate 54. The slide plate 54, as detailed below, provides a guiding surface for a wear or strip plate 106. The body 49 has a slot 51 formed therein in which is seated the slide plate 54.

The body 49, also, has a pair of spaced apart bores 60, 61 formed therein which register with a pair of bores 62, 63, respectively, formed in the plate 54 as well as a central bore 64 which registers with a bore 64' formed in the plate 54.

The slide plate 54 is a substantially T-shaped member with legs 54' and 54" normal to each other. The leg 54' sits in the slot 51 and is provided with bores 62 and 63 which register with bores 60 and 61, respectively. The leg 54' also has the central bore 64' formed therein, which registers with the bore 64 in the body 49.

A piston 66 is floatably seated in associated registering bores 60, 62 or 61, 63.

A biasing member, such as a spring 68, is disposed in the registering central bores 64, 64' and biases the slide plate 54 upwardly toward a slidable blade holder 80.

A pair of elongated guides 67, 69 of C-shaped cross-section are secured to opposite respective sides of the body 49 and overlie the slide plate 54, as shown. The guides 67, 69 not only guide, but also trap the slide plate in a stationary position.

The slide plate leg 54" defines a ramped wear surface 52 which mates with a wear plate 106 on the blade holder 80, as detailed hereinafter. Optimally, the slide plate 54 is a steel plate.

Laterally secured to the body 49 is a hardened wear block 70. The hardened wear block, as detailed hereinbelow, again, increases the longevity of the assembly.

Figure 7:
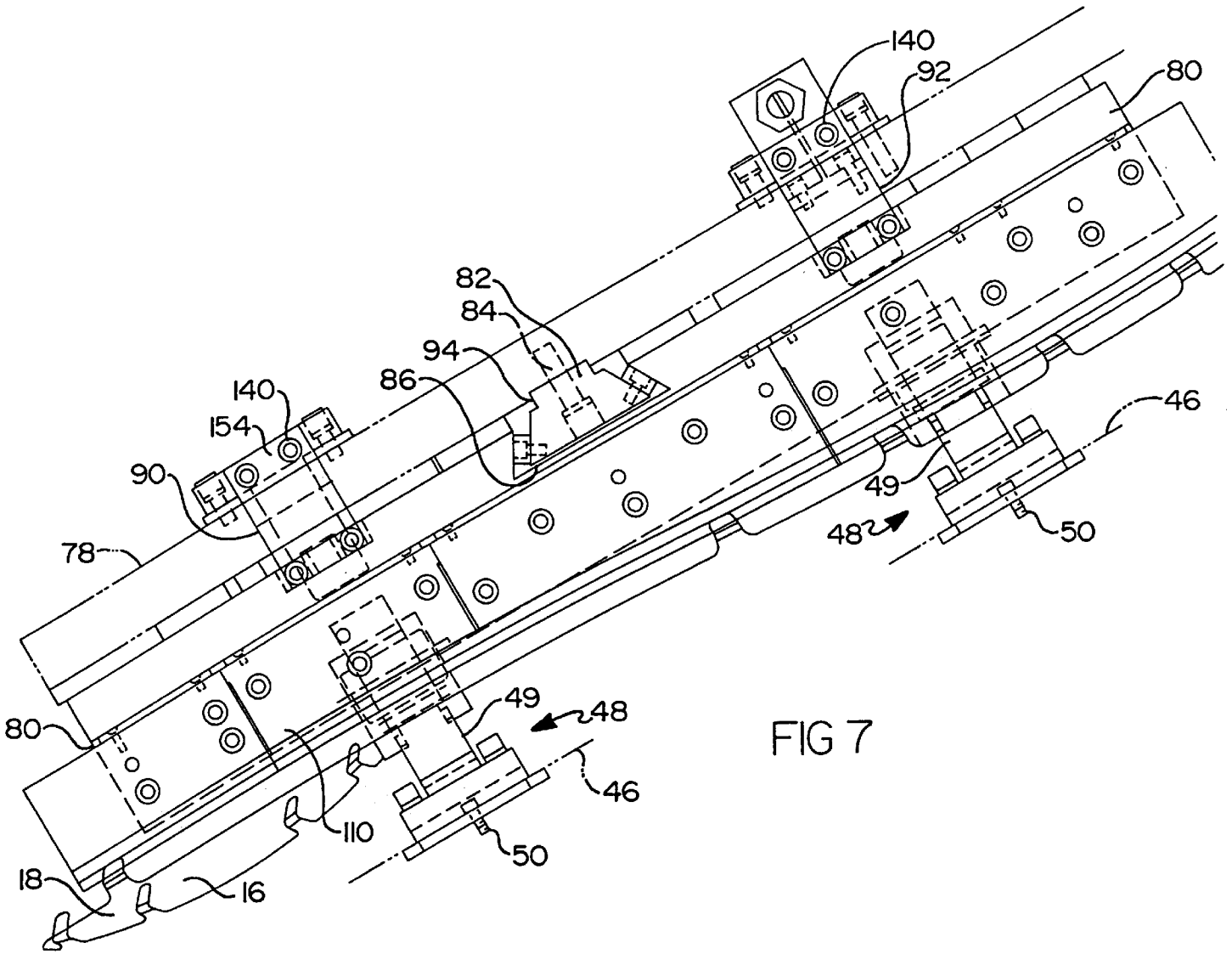
FIG. 7 is a front elevational view of the metal forming machine hereof.

As shown in FIG. 7, the present invention contemplates a plurality of cam drivers 48 comprising a plurality of elongated plates which traverse the width of the blade assembly. The cam drivers are disposed about the perimeter of the window opening 12 and are stationarily mounted to the housing top 46 by the threaded fasteners 50. It should be understood, though, that the blocks 48 may be replaced by a unitary block, which, also, is stationary during the metal forming operation.

Referring now to FIGS. 7–11, disposed above the housing 40 and circumferentially disposed about the central pillar 30 is a crown 72. The crown 72 is journalled onto and secured to the central pillar 30 by any suitable means. The crown 72 includes a central collar 76 and a header 78 integral therewith and formed thereto, such as by welding or the like. The crown 72 includes a guide block 82 for controlling the path of travel of the header 78.

The guide block 82 is fixed to the header 78 via a suitable fastener, such as a bolt 84 or the like. The guide block 82 is received in a slot 94 of and has a dovetail configuration and seats in a complementarily configured guide path or guideway 86 formed in the slidable blade holder 80, as explained below.

The header 78, also, has at least one and, preferably, at least a pair of spaced apart shuttle stop block access openings 90, 92. The openings 90, 92 enable sliding of shuttle stop block assemblies 105 associated with the crown 72.

Optimally, the slidable blade holder 80 is mounted to and downwardly depends from the header 78, as shown. The holder 80 is an elongated body or may comprise a plurality of interconnected bodies. Here, and as shown, the holder 80 is a unitary block or body 102. A guideway 86 having a dovetail configuration is formed in the block 102 in which is seated the complementarily shaped guide block 82, as shown.

Figure 8:
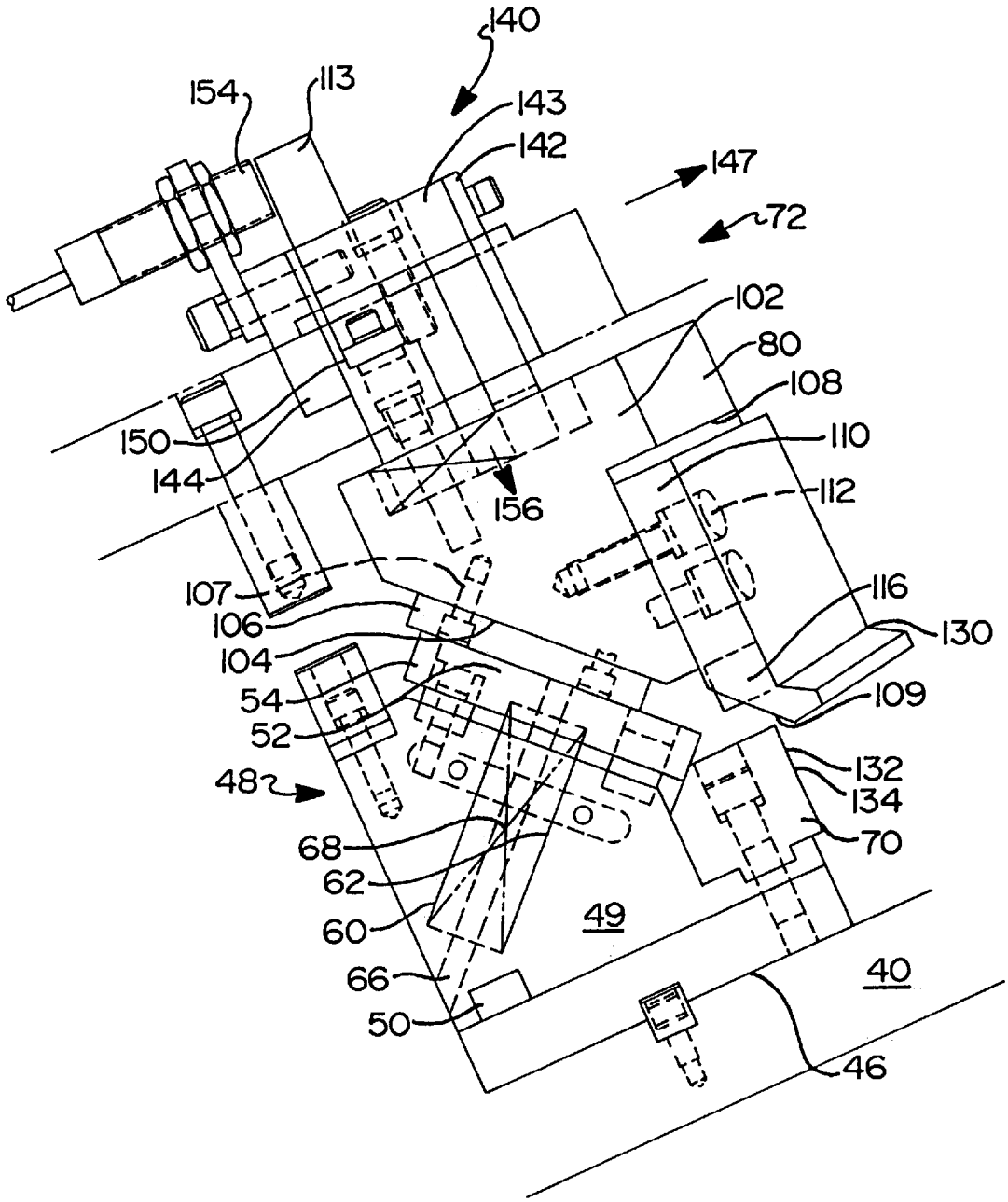
FIG. 8 is a side view, partly in isometric, of the cam driver and slidable blade holder hereof.
Figure 9:
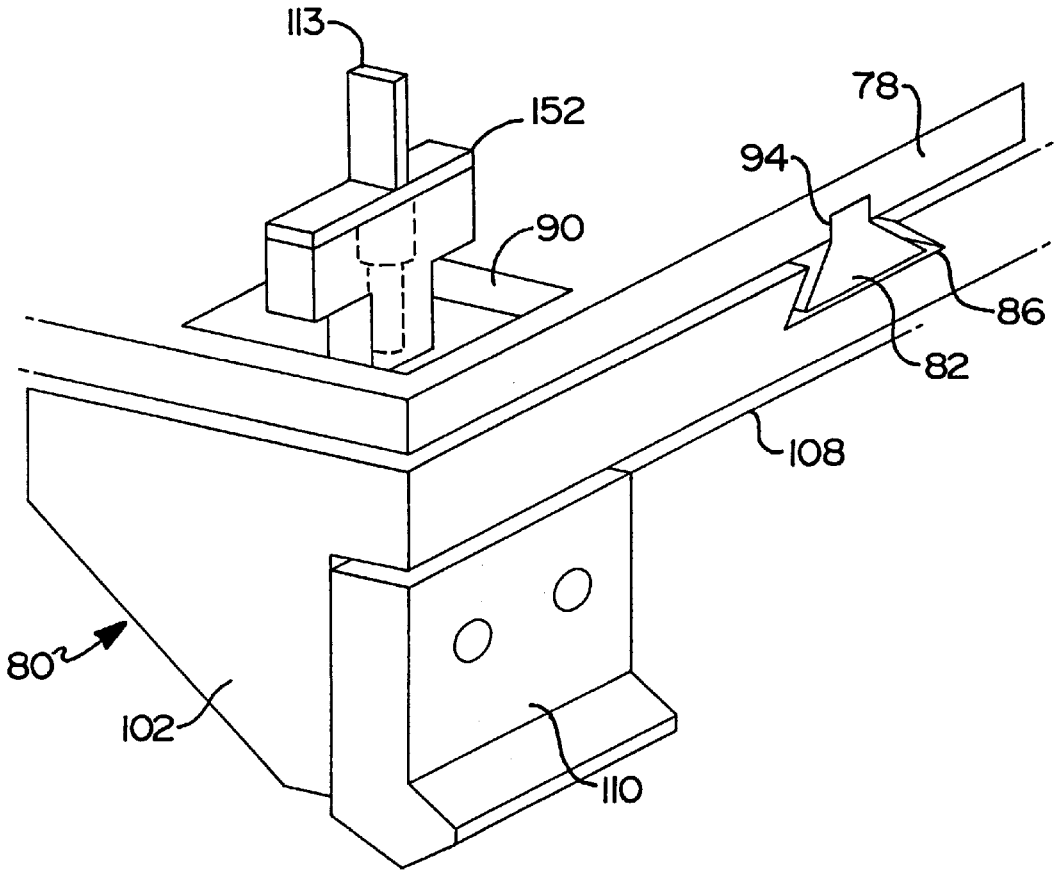
FIG. 9 is a broken perspective view of the crown and shuttle stop block hereof.

More particularly, as shown in FIGS. 8, 9 and 11, it is seen that the block 102 includes a ramped surface 104 which is complementarily angled to that of the ramped surface 52 of the slide plate 54 associated with the cam driver or lower block 48. A wear plate or wear strip 106 is secured to the ramped surface 104 by any suitable means, such as fasteners 107, and engages the ramped wear surface 52 of the slide plate 54 during sliding movement of the blade holder 80 with respect to the cam driver 48.

A lateral recess 108 is formed in the body 102, in which is seated a blade 110. The blade 110 contacts an associated flanged tab 14 (FIG. 2) during the motion thereof for imparting the requisite deformation thereto in a sequential manner. The blade 110 is, as shown, removably secured to the body 102 through a threaded fastener 112 or the like. The blade 110 has a relief 109 in the rearward portion thereof. Disposed in the relief 109 and secured thereto is a heel block 116 which is wear hardened for imparting longevity thereto. As detailed below, the heel block 116 contacts the wear block 70 during the upward and downward movement of the crown 72. The body 102 has a pair of spaced apart recesses 103, which register with associated access openings 90, 92. Disposed within the header 78 and extending into the recesses 103, are stop block assemblies 150 for limiting and directing the movement of the crown 72 and the slidable blade holder 80.

Each stop block assembly 150 includes a bumper 140 and a shuttle stop block 152. Each bumper 140 defines a limit for the outward movement of the blade holder 80. Each bumper 140 comprises a substantially U-shaped block which is mounted to the header 78 and downwardly extends therefrom and includes a front wall 142, a top wall 143 and a rear wall 144. The front wall 142 has a rear surface 146 which defines a shoulder or abutment for limiting outward movement of the blade 110 in the direction of arrow 147. Similarly, the rear wall 144 has a front surface 148 which limits rearward movement of the blade holder 80 as described below.

A slot 151 is provided in the top wall 143 of the bumper 140, as shown. It is to be appreciated that a gap 153 is defined between the rear wall 144 and the front wall 142. A shuttle stop block 152 is disposed in the gap 153 and is seated in the recess 103 of the body 102, as shown, and is slidable therewithin between the limits defined between the surfaces 146 and 148.

Extending upwardly from the shuttle stop block 152 and integral therewith is a flag 113. The flag 113 is received in the slot 151 and extends through the access opening 90 or 92. A proximity switch 154 is stationarily surmounted the bumper 140 and senses the approach of the flag 113 thereto to signal the power source to limit rearward movement of the shuttle stop block 152, in the well known manner.

In operation, and as shown in FIG. 5, as the shaft 30 is moved downwardly, in the direction of the arrow 156 the shuttle stop block 152 moves or translates in the access opening 90 of the header 78 and in the direction of the arrow 147, the direction 147 being transverse to the direction 156. After traveling its predetermined distance in the gap 153 of the bumper 140, the front wall 142 stops further movement of the stop block 152, while the force of the shaft continues to be imparted thereto. Concomitantly and simultaneously with the downward movement of the header 78, due to the interconnection between the guide block 82 extending from the header and the guideway 86 formed in the blade holder 80, as the blade holder 80 is pulled towards the slide plate 54 and the wear strip 106 forced into contact with the ramped wear surface 52 on the slide plate 54, the blade holder is slidably driven in a direction transversely to the downward movement of the shaft 30. As the path of travel is interrupted by the shuttle stop block 152 encountering the rear surface or shoulder 146, the continued motion or force thereof causes the blade holder 80 and, thus, the blade 110 to move in a similar downward direction.

In other words, during the first leg of the path of travel, the heel block 116 moves from point 130 to point 132. Continued downward motion, then, causes the heel block to move from point 132 to point 134. During this motion the blade 110 contacts the flange 18 to deform same in an outward or blooming direction, thus, bending the tabs 14,14', etc. The retraction of the shuttle stop block 152 causes a first upward motion and then a horizontal translation in the opposite direction of the motion as described above.

During the initial path of travel, the upward bias caused by the spring 68 maintains contact between the slide plate 54 and the wear strip 106. It is during the second portion of the path of travel that the spring force is overcome to enable the heel block 116 to move from point 132 to point 134.

It is to be appreciated that what is being achieved here is the downward pulling of the blade 110 caused by the motion imparted to the slidable holder or blade holder 80 because of its securement to the crown 72, which is, in turn, integral with the collar 76 and, thus, movable with the shaft 30 that causes the bending of the flange 18. Furthermore, by having the pillar or shaft 30 disposed within the opening 12, outward or blooming metal forming operation is achieved.

As hereinabove noted, the present invention has been defined in terms of a blade for metal deformation. However, a flanging element, piercing element or the like may be secured to the body 102 for carrying out the deformation action.

Furthermore, and as noted hereinabove, the central pillar or shaft 30 is hydraulically driven. However, it is to be understood that other power sources, including electromechanical, electronic, pneumatic or the like, may be used herein. Furthermore, as noted, the low profile capability of the present metal forming device enables the use of the rocker mechanism for driving the pillar and to enable it to be installed in a table top fashion. Likewise, during the metal forming operation, the pillar is downwardly driven. Retraction is accomplished by the upward driving of the pillar. However, these motions can be reversed.

It should be further noted with respect hereto that where the aperture 12 or strip 16 has comers which must be finished, an external metal forming or finishing device, such as an anvil or the like (not shown), can be used for synchronous motion with the metal forming device hereof, at the corners, as the blade 110 moves outwardly.

In order to provide a sound metal finishing operation, other elements may be incorporated into the device such as an anti-rotation element or pin 160 for stabilizing the crown and the housing and for preventing unwanted rotation of the shaft 30. Similarly, a shaft collar 162 may be secured to the top of the pillar 30 for adjusting the torque or the like.

By virtue of the ramped surfaces, metal forming is accomplished even though the driving motions are only in the vertical and horizontal direction. It is the ramped surfaces, with the angular incline, that enables the blade assembly to move into and out of contact with the tab-bearing flange.

As noted, where more than one blade assembly is employed, the blades are linked together through the dove tail for synchronous motion therewith.

Also, and as stated above, the present metal forming device or machine enables the disposition of the central pillar 30 within the aperture 12 with outward blooming or, stated alternatively, metal forming from the interior of the aperture outwardly.

It is to be appreciated that the present invention combines a unique and simplified way of carrying out a metal forming operation about an opening formed in a provided thin metal while eliminating the potential of crimping, scarfing or the like.

While the invention has been illustrated and described in detail in the drawings and in the foregoing description, the same is to be considered as illustrative and not restrictive in character, it being understood that only the preferred embodiment has been shown and described fully and that all changes and modifications that come within the spirit of the invention are desired to be protected.

Having, thus, described the invention what is claimed is:

1. A metal forming machine which comprises:

(a) a stationary housing;

(b) a central movable pillar or drive shaft, said drive shaft having an upper end portion axially spaced from a lower end portion and a medial portion secured to said housing for axial reciprocating movement thereto, (c) a header secured to the upper end portion of the pillar and movable therewith in a direction towards and away from the housing;

(d) blade assembly mounted to the header and movable therewith, the blade assembly including:

(i) a slidable holder, the holder being slidably mounted to the header for movement in first and second directions transverse to the direction of reciprocation and including a ramped surface, and (ii) a forming element mounted to the holder and slidable therewith;

(e) means disposed within the header for limiting and directing movement of the blade holder;

(f) a stationary slide plate, the slide plate being connected to the housing and having a surface that defines a ramped surface which mates with the slidable holder for guiding the holder in a path of travel along the ramped surface; and (g) rocker means connected to the lower end portion of the shaft for driving the shaft.

2. The machine of claim 1 which comprises:

at least one cam driver secured to the housing in facing relation to the blade holder and comprising a body having a ramped wall, the slide plate being fixed to the ramped wall.

3. The machine of claim 2 which further comprises:

means for biasing the slide plate toward the blade holder.

4. The machine of claim 1 which comprises:

a plurality of cam drivers which cooperate to traverse the width of the blade assembly, each cam driver comprising:

(a) a body having a ramped wall, and (b) a slide plate being fixed to the ramped wall.

5. The device of claim 1, wherein said means disposed within the header for limiting and directing movement of the blade holder comprises:

a proximity switch operably connected to said rocker means to limit the downward movement of said pillar and the blade assembly thereof towards said slide plate, and at least one stop block disposed, at least in part, in said header and in said blade assembly and slidably movable in said first and second directions with movement in one of said directions operating said proximity switch.

6. The device of claim 5 which further comprises:

a U-shaped bumper associated with each stop block assembly, each bumper limiting movement of an associated forming element in said first direction and in a second and opposite direction.

7. The device of claim 1 which comprises:

a plurality of forming elements secured to the slidable holder.

8. The device of claim 1, wherein a shaped guideway is provided in one of said blade holder and said header, and a guide block extends from the other of said blade holder and said header, said guide block being complementarily shaped to and received in said guideway for controlling the path of travel of the header.

9. A metal forming machine for forming a workpiece, said machine comprising:

a stationary forming fixture having a support surface, said forming fixture including a cam driver and a housing member each mounted on and extending upwardly from said support surface, said cam driver including a slide plate with a surface of said slide plate defining a ramped surface, a drive shaft, said drive shaft having upper and lower end portions spaced axially and a medial portion thereof journalled in said housing member for reciprocating movement in opposite axial directions, a blade assembly mounted to the upper end portion of the drive shaft and movable therewith towards and away from the cam driver, said blade assembly comprising: a header, a blade holder, a forming blade mounted to the blade holder, and mounting means connecting the blade holder to the header for sliding movement in first and second directions transverse to the direction of reciprocation, said blade holder including a ramped surface which mates with the ramped surface of the slide plate for forcing the blade holder in a path of travel along the ramped surface of the slide plate as the upper end portion of the drive shaft reciprocates towards and away from the cam driver, a rocker member connected to the lower end portion of said drive shaft for reciprocating the drive shaft, switch means operatively connected to said rocker member for simultaneously limiting the upward movement of said drive shaft and the movement of the blade holder in a direction away from said cam driver and in said first direction transverse to the direction of reciprocation, and limiting means extending between the header and the blade holder for simultaneously limiting the downward movement of said drive shaft and the movement of said blade holder in a direction towards said cam driver and in said second direction opposite to said first direction.

* * * * *